US009618897B2

(12) United States Patent
Kiyosumi

(10) Patent No.: US 9,618,897 B2
(45) Date of Patent: Apr. 11, 2017

(54) IMAGE FORMING APPARATUS CAPABLE OF ADJUSTING SENSITIVITY OF OPTICAL SENSOR AND METHOD FOR ADJUSTING SENSITIVITY OF OPTICAL SENSOR

(71) Applicant: KYOCERA Document Solutions Inc., Osaka (JP)

(72) Inventor: Tadahiro Kiyosumi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/072,682

(22) Filed: Mar. 17, 2016

(65) Prior Publication Data

US 2016/0274491 A1 Sep. 22, 2016

(30) Foreign Application Priority Data

Mar. 19, 2015 (JP) ..... 2015-056441

(51) Int. Cl.
*G03G 21/12* (2006.01)
*G03G 15/08* (2006.01)

(52) U.S. Cl.
CPC ..... *G03G 21/12* (2013.01); *G03G 15/0862* (2013.01)

(58) Field of Classification Search
CPC ..... G03G 15/0862; G03G 15/0855; G03G 2215/0891; G03G 2215/0894; G03G 21/10; G03G 21/12
See application file for complete search history.

(56) References Cited

U.S. PATENT DOCUMENTS

2010/0074644 A1* 3/2010 Kyung ..... G03G 15/0862 399/71

FOREIGN PATENT DOCUMENTS

| | | | |
|---|---|---|---|
| JP | H06-006198 A | | 1/1994 |
| JP | H06-042908 A | | 2/1994 |
| JP | 2010128345 A | * | 6/2010 |
| JP | 2011039167 A | * | 2/2011 |

OTHER PUBLICATIONS

Machine translation of Sunayama (2010).*

* cited by examiner

*Primary Examiner* — Sevan A Aydin
(74) *Attorney, Agent, or Firm* — IP Business Solutions, LLC

(57) ABSTRACT

An image forming apparatus includes: an optical sensor which includes a light-emitting part and a light-receiving part opposed to the light-emitting part and is configured to detect an amount of waste toner accumulated in a waste toner container, the waste toner being produced with formation of an image and then accommodated in the waste toner container; a detecting section configured to detect a change in an output of the light-receiving part; a shielding member interposed between the light-emitting part and the light-receiving part and configured to create, between the light-emitting part and the light-receiving part, a light-transmitting environment equivalent to that when the waste toner container is filled with the waste toner; and an adjusting section configured to adjust a light intensity of the light-emitting part when the shielding member is interposed between the light-emitting part and the light-receiving part.

5 Claims, 9 Drawing Sheets

IMAGE FORMING APPARATUS CAPABLE OF ADJUSTING SENSITIVITY OF OPTICAL SENSOR AND METHOD FOR ADJUSTING SENSITIVITY OF OPTICAL SENSOR

INCORPORATION BY REFERENCE

This application claims priority to Japanese Patent Application No. 2015-56441 filed on Mar. 19, 2015, the entire contents of which are incorporated by reference herein.

BACKGROUND

The present disclosure relates to image forming apparatuses and methods for adjusting the sensitivity of an optical sensor.

There is well known, as an example of a general image forming apparatus, an electrophotographic image forming apparatus constituted by five processes: uniformly electrically charging an uncharged photoconductor (charging process); irradiating the surface of the charged photoconductor with laser light based on an original document to be copied, thus forming a latent image of the original document on the surface of the photoconductor (exposure process); making the latent image visible with toner (development process); transferring a toner image formed by making the visible image to a recording medium, such as a paper sheet, placed on a transfer belt (transfer process), and fixing the transferred toner image on the recording medium (fixation process).

Toner on the surface of the photoconductor is not entirely transferred to the recording medium but a small amount of the toner remains on the surface of the photoconductor. The toner remaining on the surface of the photoconductor is collected as waste toner by a cleaning device and conveyed to a waster toner bottle or the like. For example, toner remaining untransferred on the surface of the photoconductor is scraped off from the surface of the photoconductor by a cleaning blade made of resin or other materials, conveyed through a waste toner conveying pipe, and finally collected into the waste toner bottle.

An image forming apparatus to which such a waste toner bottle can be attached is provided with a means for detecting that the waste toner bottle has been filled with waste toner. An example of the method for detecting that the waste toner bottle is filled with waste toner is a method in which a pair of light-emitting and light-receiving parts of an optical sensor are disposed near an inlet of the waste toner bottle with the inlet between them and the waste toner bottle is determined to be full when light emitted from the light-emitting part is blocked by the waste toner accumulated in the waste toner bottle and thus the optical sensor detects that the amount of light received by the light-receiving part has become small.

An LED constituting a component of the light-emitting part of the optical sensor and a phototransistor constituting a component of the light-receiving part thereof have a problem that their performances significantly vary among individual pieces, so that the sensitivity of the optical sensor also significantly varies from combination to combination of the pair of light-emitting and light-receiving parts. Therefore, after the optical sensor is mounted to the apparatus body, it is necessary to adjust, for each apparatus, the light intensity of the LED and the sensitivity of light falling on the phototransistor, thus adjusting the sensitivity of the optical sensor. Various methods for adjusting the sensitivity of light falling on the phototransistor are proposed.

SUMMARY

A technique improved over the aforementioned techniques is proposed as one aspect of the present disclosure.

An image forming apparatus according to an aspect of the present disclosure includes an optical sensor, a detecting section, a shielding member, and an adjusting section.

The optical sensor includes a light-emitting part and a light-receiving part opposed to the light-emitting part and is configured to detect an amount of waste toner accumulated in a waste toner container, the waste toner being produced with formation of an image and then accommodated in the waste toner container.

The detecting section is configured to detect a change in an output of the light-receiving part.

The shielding member is interposed between the light-emitting part and the light-receiving part and configured to create, between the light-emitting part and the light-receiving part, a light-transmitting environment equivalent to that when the waste toner container is filled with the waste toner.

The adjusting section is configured to adjust a light intensity of the light-emitting part when the shielding member is interposed between the light-emitting part and the light-receiving part.

A method for adjusting a sensitivity of an optical sensor according to another aspect of the present disclosure is a method for adjusting a sensitivity of an optical sensor configured to detect an amount of waste toner accumulated in a waste toner container, the waste toner being produced with formation of an image and then accommodated in the waste toner container. The method for adjusting a sensitivity of an optical sensor according to this aspect of the present disclosure includes at least two steps below.

The first step is the step of interposing, between a light-emitting part and a light-receiving part of the optical sensor, a shielding member configured to create a light-transmitting environment equivalent to that when the waste toner container is filled with the waste toner.

The second step is the step of adjusting a light intensity of the light-emitting part according to a change in an output of the light-receiving part and setting the light intensity of the light-emitting part at a level exhibited when the output of the light-receiving part reaches a predetermined condition.

DETAILED DESCRIPTION

Figure 1:
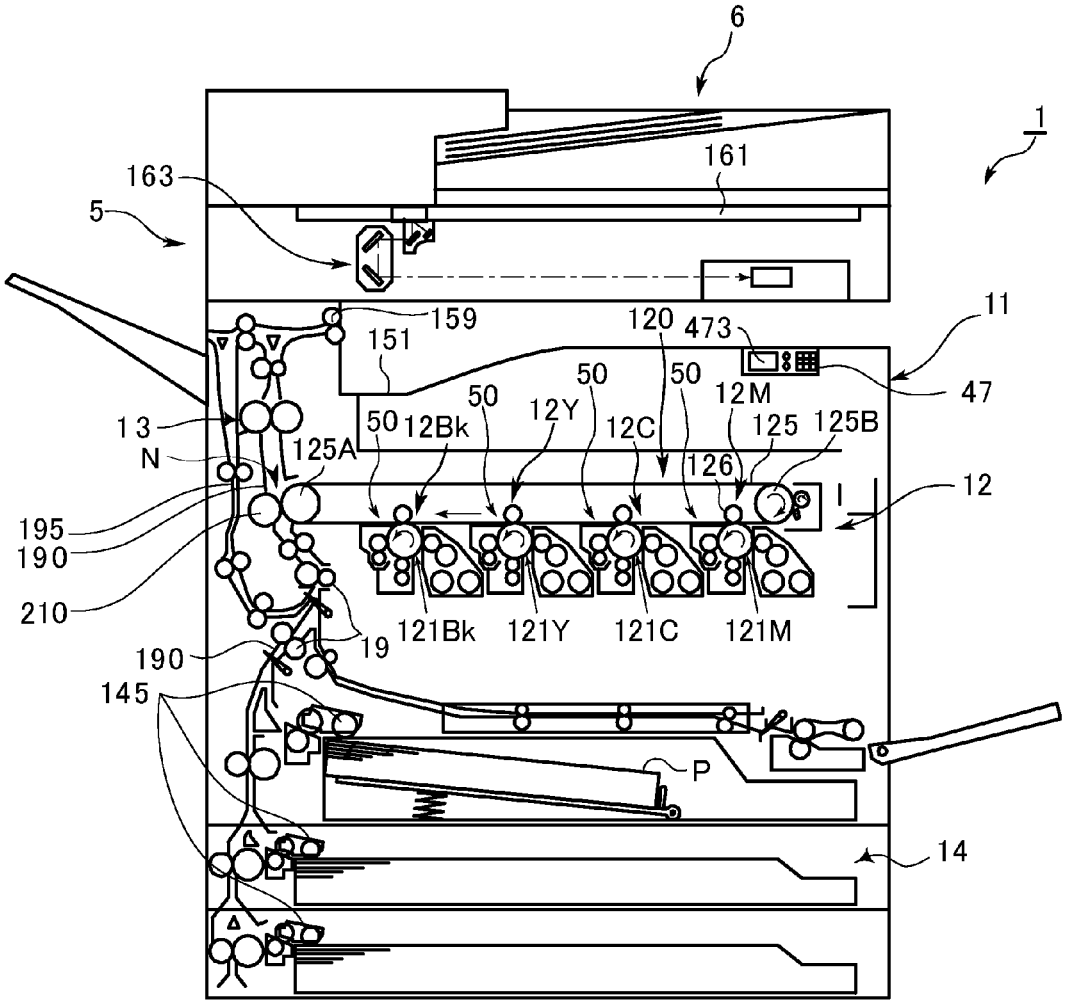
FIG. 1 is a schematic, partial cross-sectional front view showing the structure of an image forming apparatus according to a first embodiment of the present disclosure.

Hereinafter, a description will be given of an image forming apparatus and a method for adjusting the sensitivity of an optical sensor, both according to an embodiment of the present disclosure, with reference to the drawings. FIG. 1 is a schematic, partial cross-sectional front view showing the structure of an image forming apparatus according to a first embodiment of the present disclosure.

The image forming apparatus 1 according to the first embodiment of the present disclosure is a multifunction peripheral having multiple functions including, for example, a copy function, a print function, a scan function, and a facsimile function. The image forming apparatus 1 is made up so that an apparatus body 11 thereof includes an operating section 47, a document feed section 6, and a document reading section 5.

The operating section 47 is configured to accept operator's instructions for various types of operations and processing executable by the image forming apparatus 1, such as an instruction to perform an image forming operation and an instruction to perform a document reading operation, and includes a display 473 configured to display operation guidance and so on for the operator.

First, a description will be given of the case where the document reading operation is performed on the image forming apparatus 1. The document reading section 5 optically reads an image of an original document being fed by the document feed section 6 or an image of an original document placed on an original glass plate 161 and generates image data. The image data generated by the document reading section 5 is stored on an internal HDD (hard disk drive), a network-connected computer or the like.

Next, a description will be given of the case where the image forming operation is performed on the image forming apparatus 1. An image forming section 12 forms a toner image on a paper sheet P serving as a recording paper sheet fed from a sheet feed section 14, based on image data generated by the document reading operation, image data stored on the internal HDD or image data received from a network-connected computer.

The image forming section 12 is made up by including an image forming unit 12M for magenta (M), an image forming unit 12C for cyan (C), an image forming unit 12Y for yellow (Y), and an image forming unit 12Bk for black (Bk). The image forming units 12M, 12C, 12Y, and 12Bk include their respective drum-type photoconductors 121M, 121C, 121Y, and 121Bk. The photoconductors 121M, 121C, 121Y, and 121Bk are configured to be driven into rotation counterclockwise shown in the figure. The image forming units 12M, 12C, 12Y, and 12Bk are examples of the developing device defined in What is claimed is.

A transfer unit 120 is made up by including: an intermediate transfer belt 125 having an outer peripheral surface to which a toner image is to be transferred; a drive roller 125A; a driven roller 125B; and four primary transfer rollers 126.

The intermediate transfer belt 125 is mounted between the drive roller 125A and the driven roller 125B and configured to be driven in engagement against the peripheral surfaces of the photoconductors 121M, 121C, 121Y, and 121Bk by the drive roller 125A and travel in an endless path around the rollers 125A, 125B while synchronizing with each photoconductor 121M, 121C, 121Y, 121Bk.

Next, a description will be given of the case where color printing is performed. The peripheral surfaces of the photoconductors 121M, 121C, 121Y, and 121Bk are uniformly electrically changed (charging process), the charged surfaces of the photoconductors 121M, 121C, 121Y, and 121Bk are irradiated with laser light based on image data to form respective latent images thereon (exposure process), the latent images are made visible with toner (development process), and the toner images formed by making the visible images are transferred onto the intermediate transfer belt 125 by the primary transfer rollers 126.

The toner images of different colors (magenta, cyan, yellow, and black) transferred to the intermediate transfer belt 125 are superimposed each other on the intermediate transfer belt 125 by adjusting their transfer timings, resulting in a multicolor toner image.

A secondary transfer roller 210 is configured to transfer the multicolor toner image formed on the surface of the intermediate transfer belt 125, at a nip N between the secondary transfer roller 210 and the drive roller 125A with the intermediate transfer belt 125 in between, to a paper sheet P conveyed from the sheet feed section 14 along a conveyance path 190. The description given thus far is of the case of color printing. In the case of black-and-white printing, the photoconductors 121M, 121C, and 121Y for magenta, cyan, and yellow are not used and only the photoconductor 121Bk for black is used.

A fixing section 13 is configured to fix the toner image on the paper sheet P by the application of heat and pressure. The paper sheet P on which a multicolor image has been formed and fixed is discharged to a sheet output tray 151.

The sheet feed section 14 is made up by including a plurality of sheet feed cassettes and their respective pick-up rollers 145 for picking up recording paper sheets contained in the sheet feed cassettes. To pick up a recording paper sheet of a size designated by an operator's instruction or the like, the relevant pick-up roller 145 is rotationally driven. Thus, the designated recording paper sheet is fed toward the nip N.

A description will be given of the case where double-sided printing is performed on the image forming apparatus 1. The paper sheet P having an image already formed on one side by the image forming section 12 is nipped by an output roller pair 159, then moved back and conveyed to a reverse conveyance path 195 by the output roller pair 159, and conveyed again upstream in the direction of conveyance by a conveyance roller pair 19. Thus, an image can also be formed on the other side of the paper sheet P.

A static eliminating section 50 is provided for each of the photoconductors 121M, 121C, 121Y, and 121Bk to remove residual charge on the surface of the associated photoconductor 121M, 121C, 121Y, 121Bk and is configured to irradiate the surface of the photoconductor 121M, 121C, 121Y, 121Bk with static eliminating light after the image formation of the associated image forming unit 12M, 12C, 12Y, 12Bk.

Figure 2:
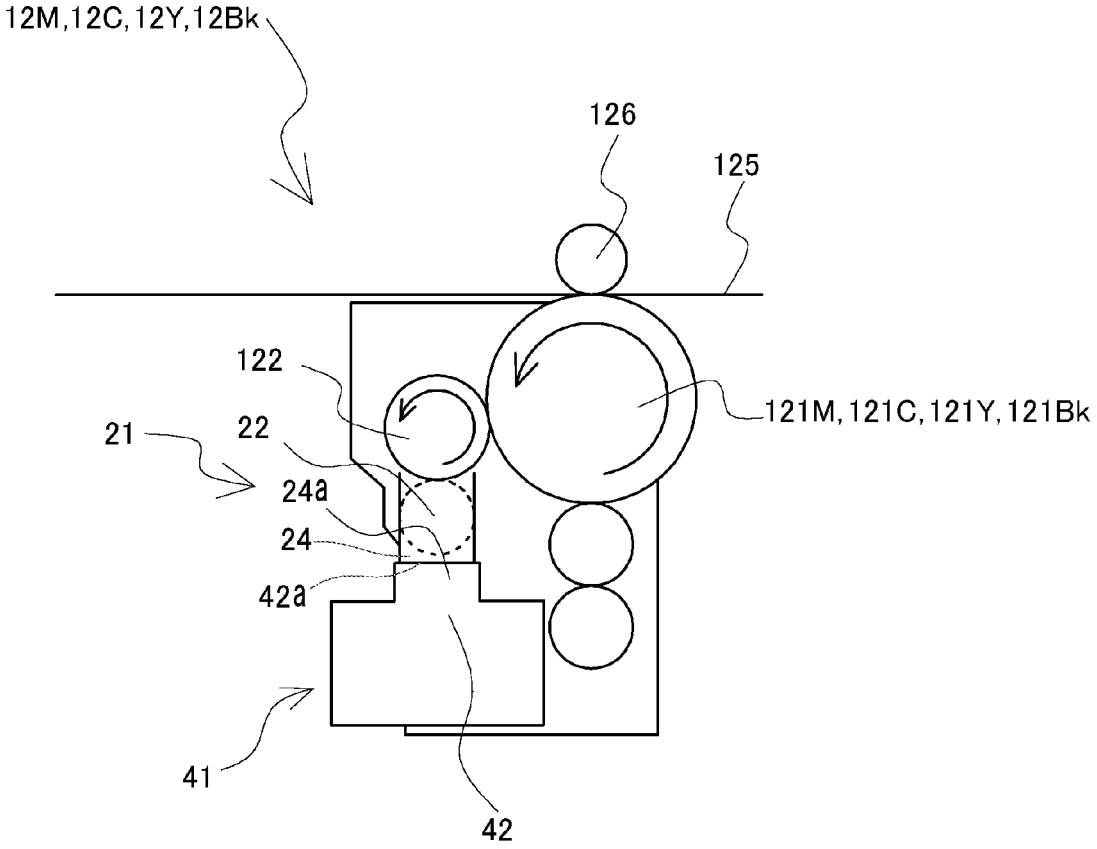
FIG. 2 is a front view schematically showing an essential part of a waste toner collecting mechanism in the image forming apparatus according to the first embodiment of the present disclosure.
Figure 3:
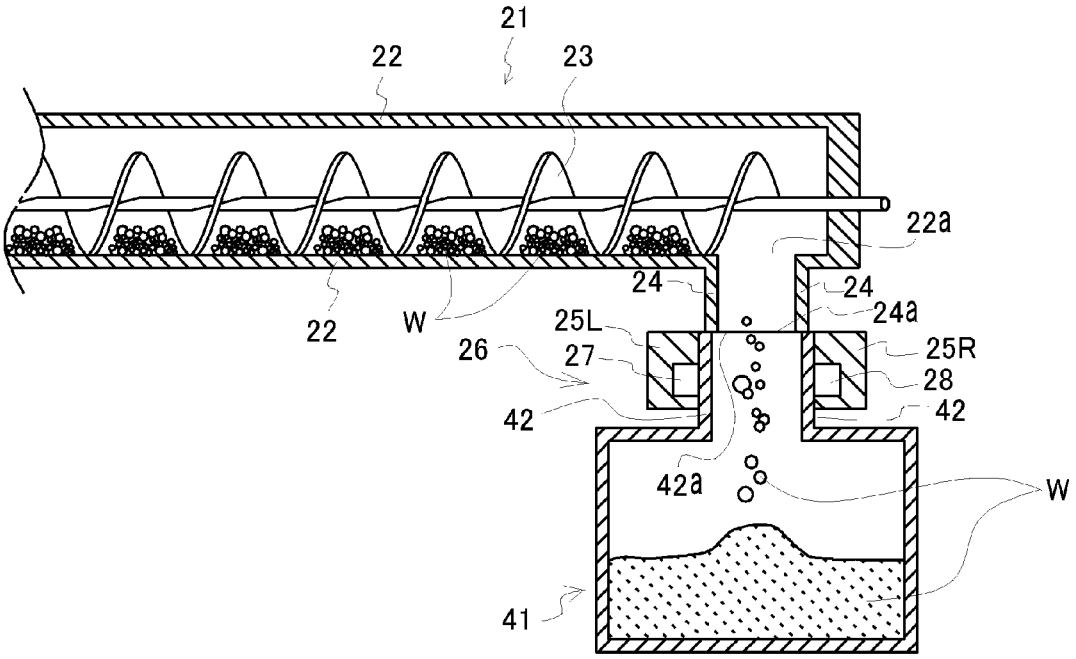
FIG. 3 is a cross-sectional side view schematically showing the essential part of the waste toner collecting mechanism in the image forming apparatus according to the first embodiment of the present disclosure.

FIG. 2 is a front view schematically showing an essential part of a waste toner collecting mechanism in the image forming apparatus according to the first embodiment of the present disclosure and FIG. 3 is a cross-sectional side view schematically showing the essential part of the waste toner collecting mechanism in the image forming apparatus according to the first embodiment of the present disclosure.

A waste toner collecting mechanism 21 is provided to the left of each photoconductor 121M, 121C, 121Y, 121Bk shown in FIG. 2 and includes a cleaning roller 122 capable of removing toner remaining untransferred on the surface of the photoconductor 121M, 121C, 121Y, 121Bk.

The cleaning roller 122 has an axis parallel with the axis of the relevant photoconductor 121M, 121C, 121Y, 121Bk and is configured to, during the formation of a toner image, rotate in the same direction as the rotation of the photoconductor 121M, 121C, 121Y, 121Bk and rub the untransferred toner from the surface of the photoconductor 121M, 121C, 121Y, 121Bk.

Alternatively, instead of using the cleaning roller 122, a blade or brush made of resin or other materials may be engaged against the surface of the photoconductor 121M, 121C, 121Y, 121Bk to scrape off residual toner on the surface of the photoconductor 121M, 121C, 121Y, 121Bk.

The waste toner collecting mechanism 21 collects as waste toner W the toner removed from the surface of the photoconductor 121M, 121C, 121Y, 121Bk by the cleaning roller 122. The waste toner collecting mechanism 21 is made up by including the cleaning roller 122, a waste toner conveying pipe 22 for conveying toner, a conveying spiral 23 formed in the interior of the waste toner conveying pipe 22, and a waste toner discharge pipe 24 connected to a waste toner bottle 41. The waster toner bottle 41 is made of light transmissive resin or like material and configured to accommodate waste toner W.

The waste toner conveying pipe 22 extends in the axial direction of the cleaning roller 122 and is provided internally with the conveying spiral 23. With the rotation of the conveying spiral 23, the toner removed from the surface of the photoconductor 121N, 121C, 121Y, 121Bk is conveyed as waste toner W and finally collected into the waste toner bottle 41.

A hole 22*a* is formed at an end of the bottom surface of the waste toner conveying pipe 22 and connected to the waste toner discharge pipe 24, so that the waste toner W conveyed through the waste toner conveying pipe 22 can free-fall out through the hole 22*a* into the waste toner discharge pipe 24.

A discharge port 24*a* through which the waste toner W is to be discharged is formed at an end of the waste toner discharge pipe 24 opposite to the other end connected to the waste toner conveying pipe 22. The discharge port 24*a* is configured to abut on an accommodation port 42*a* formed in a neck 42 of the waste toner bottle 41. A pair of supports 25L, 25R sandwich the neck 42 of the waste toner bottle 41 from either side and support the waste toner bottle 41 with the accommodation port 42*a* abutting on the discharge port 24*a*.

The support 25L is provided internally with a light-emitting part 27 including a light-emitting element (for example, an infrared LED), the other support 25R is provided internally with a light-receiving part 28 including a light-receiving element (for example, a phototransistor), and the light-emitting part 27 and the light-receiving part 28 constitute an optical sensor 26 for detecting that the waste toner bottle 41 is filled with waste toner. The optical sensor 26, the light-emitting part 27, the light-receiving part 28, and the waste toner bottle 41 are examples of the optical sensor, the light-emitting part, the light-receiving part, and the waste toner container, respectively, defined in What is claimed is.

Figure 4:
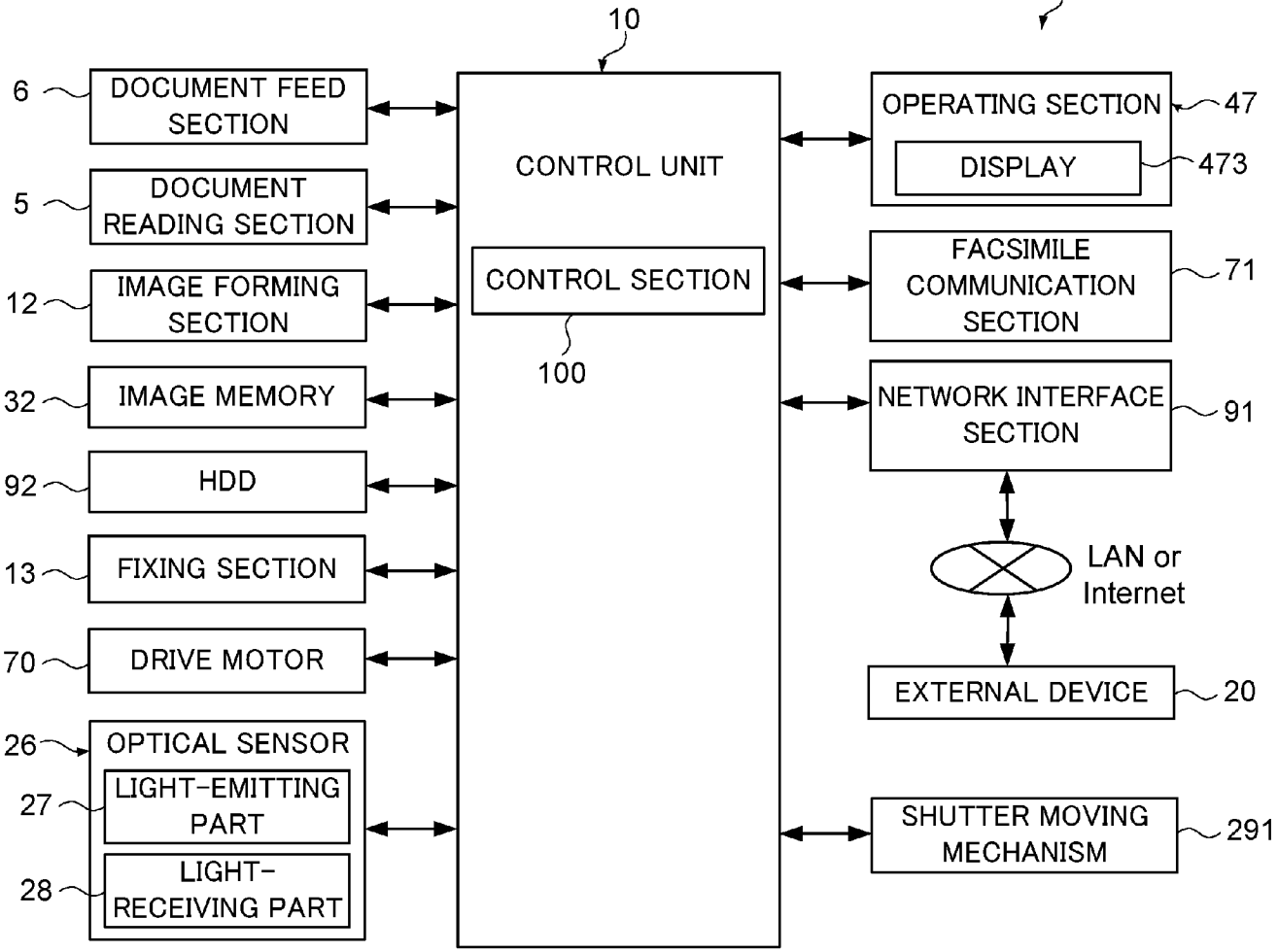
FIG. 4 is a functional block diagram schematically showing an essential internal configuration of the image forming apparatus according to the first embodiment of the present disclosure.

FIG. 4 is a functional block diagram schematically showing an essential internal configuration of the image forming apparatus 1. The image forming apparatus 1 is made up by including a control unit 10, the document feed section 6, the document reading section 5, the image forming section 12, an image memory 32, an HDD 92, the fixing section 13, a drive motor 70, the operating section 47, a facsimile communication section 71, and a network interface section 91. The same components as those of the image forming apparatus 1 shown in FIG. 1 and the waste toner collecting mechanism shown in FIG. 2 will be designated by the same references and further explanation thereof will be omitted here.

The document reading section 5 is under control of a control section 100 constituting an element of the control unit 10 and includes a reader 163 (see FIG. 1) including a lighting part, a CCD (charge coupled device) sensor, and so on. The document reading section 5 is configured to read a document image from an original document by irradiating the document with light using the lighting part and receiving the reflected light on the CCD sensor.

The image memory 32 provides a region for temporarily storing image data of the original document acquired by reading by the document reading section 5 and temporarily saving data to be printed by the image forming section 12. The HDD 92 is a large storage device capable of storing image data and so on of original documents read by the document reading section 5.

The drive motor 70 is a drive source for applying a rotary drive force to various rotary members of the image forming section 12, the conveyance roller pair 19, and other rotary members. The facsimile communication section 71 includes a coding/decoding section, a modulation/demodulation section, an NCU (network control unit), and so on, all of which are not illustrated, and performs facsimile communication using a public telephone network.

The optical sensor 26 includes the light-emitting part 27 and the light-receiving part 28 and is configured to detect, based on a change in the output of the light-receiving part 28, that the waste toner bottle 41 shown in FIGS. 1 and 2 is filled with waste toner.

The network interface section 91 is made up by including a communication module, such as a LAN (local area network) board, and is configured to transfer various data to and from external devices 20, such as personal computers, in a local area or on the Internet via a LAN or the like connected to the network interface section 91.

The control unit 10 is made up by including a CPU (central processing unit), a RAM (random access memory), a ROM (read only memory), and a dedicated hardware circuit and includes the control section 100 that governs the overall operation control of the image forming apparatus 1.

Furthermore, the control unit 10 functions as the control section 100 by operating in accordance with an image processing program installed in the HDD 92. However, the control section 100 may not be implemented by the operation of the control unit 10 in accordance with the image processing program but may be constituted by a hardware circuit. Hereinafter, the same applies to the other embodiments unless otherwise stated.

A shutter moving mechanism 291 is configured to move a movable shutter 29 for preventing waste toner from falling from the discharge port 24*a* of the waste toner discharge pipe 24, as shown in FIGS. 5A, 5B, 5C, 6A, and 6B below, and constituted by an urging member 30, such as a coil spring.

Figure 5A:
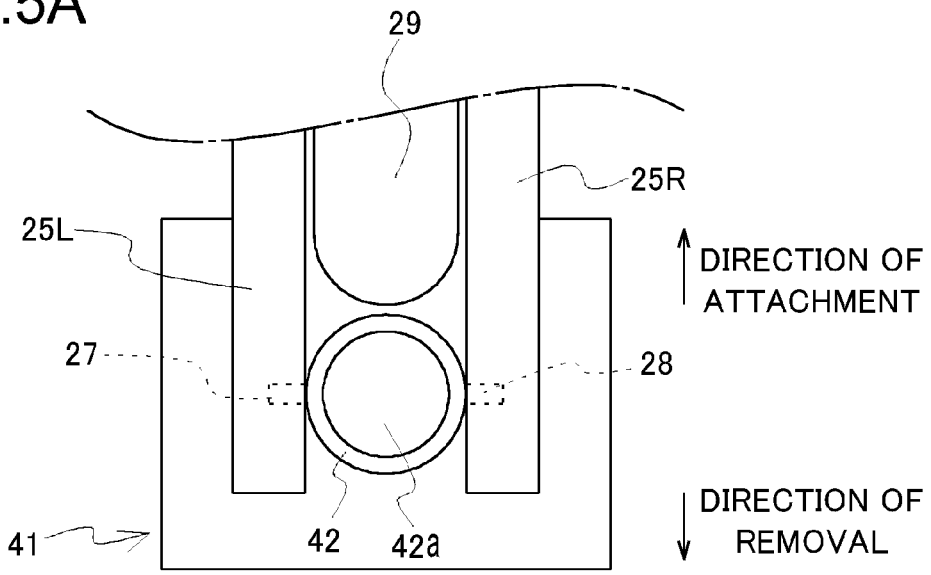
FIG. 5A is a view of a waste toner bottle as viewed from above.

FIG. 5A is a view of the waste toner bottle 41 as viewed from above. As shown in FIG. 5A, the neck 42 of the waste toner bottle 41 is supported by being sandwiched between the supports 25L and 25R. The movable shutter 29 is urged in a direction of removal of the waste toner bottle 41 from the body of the image forming apparatus 1, so that when the waste toner bottle 41 is removed, it covers the discharge port 24*a* of the waste toner discharge pipe 24 shown in FIG. 3 to prevent waste toner W from falling from the discharge port 24*a*.

Figure 5B:
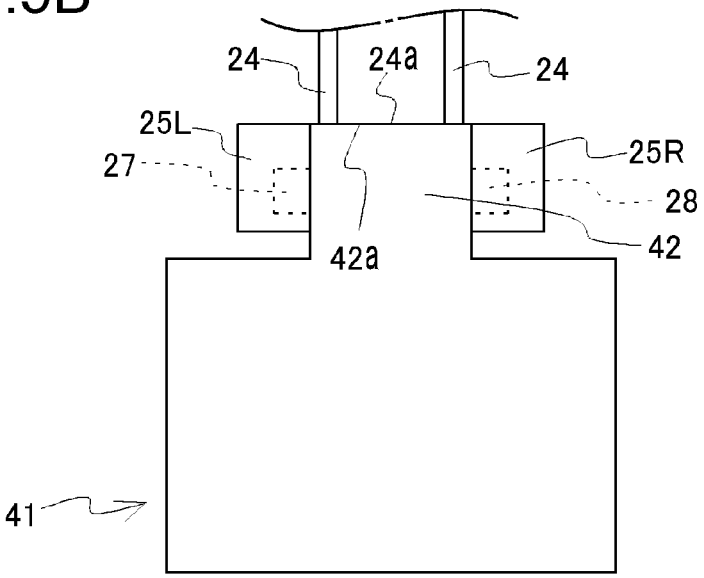
FIG. 5B is a front view showing a state where the waste toner bottle is attached to an apparatus body.
Figure 5C:
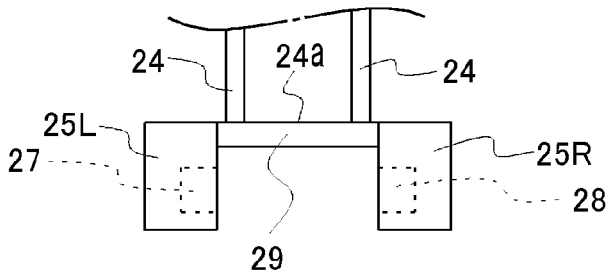
FIG. 5C is a front view showing a state where the waste toner bottle is removed from the apparatus body.

FIG. 5B is a front view showing a state where the waste toner bottle 41 is attached to the apparatus body 11 and FIG. 5C is a front view showing a state where the waste toner bottle 41 is removed from the apparatus body 11. As shown in FIG. 5C, when the waste toner bottle 41 is removed, the movable shutter 29 covers the discharge port 24*a* to prevent waste toner from falling from the discharge port 24*a*.

Figure 6A:
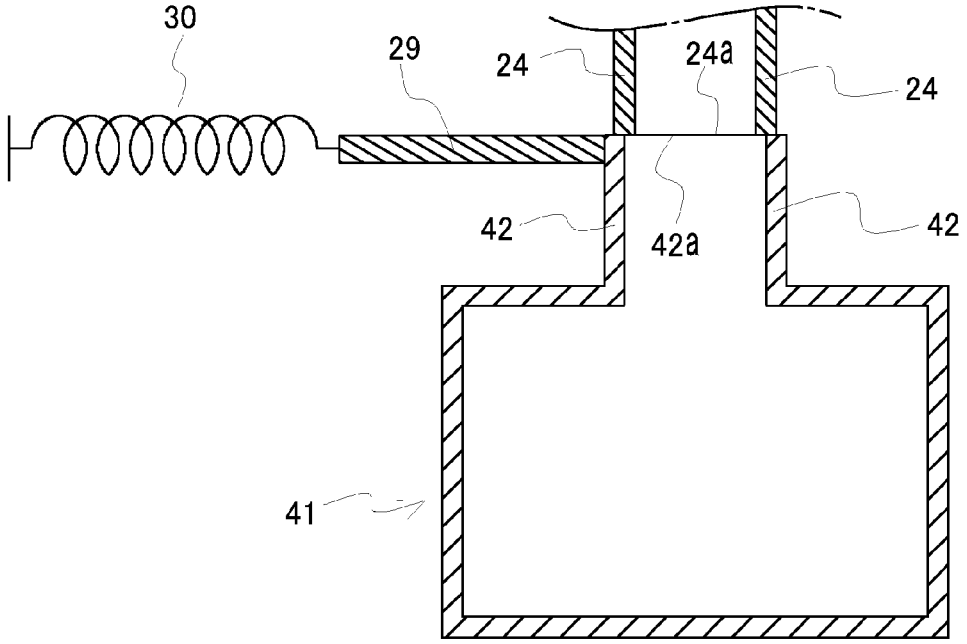
FIG. 6A is a cross-sectional side view showing the state where the waste toner bottle is attached to the apparatus body.
Figure 6B:
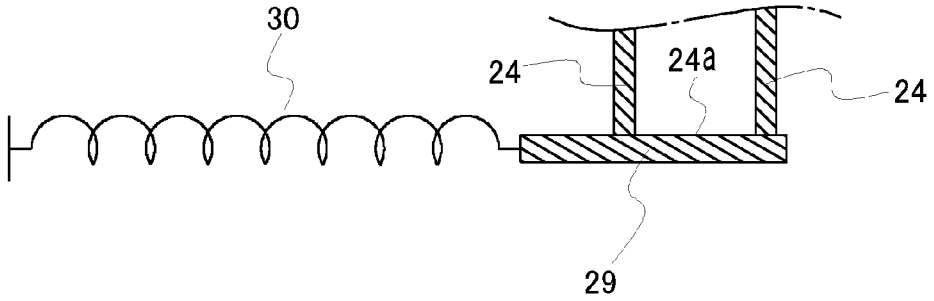
FIG. 6B is a cross-sectional side view showing the state where the waste toner bottle is removed from the apparatus body.

FIG. 6A is a cross-sectional side view showing the state where the waste toner bottle 41 is attached to the body of the image forming apparatus and FIG. 6B is a cross-sectional side view showing the state where the waste toner bottle 41 is removed from the body of the image forming apparatus. As shown in FIGS. 6A and 6B, the movable shutter 29 is urged in the direction of removal of the waste toner bottle 41 by the urging member 30, such as a coil spring. In other words, attached to the movable shutter 29 is the urging member 30 urging the movable shutter 29 in the direction of removal which is opposite to a direction of attachment of the waste toner bottle 41 to the apparatus body 11.

Thus, in attaching and removing the waste toner bottle 41 to and from the waste toner collecting mechanism 21 of the image forming apparatus 1, the discharge port 24*a* can be opened and closed by the movable shutter 29 according to the attachment and removal.

Figure 7:
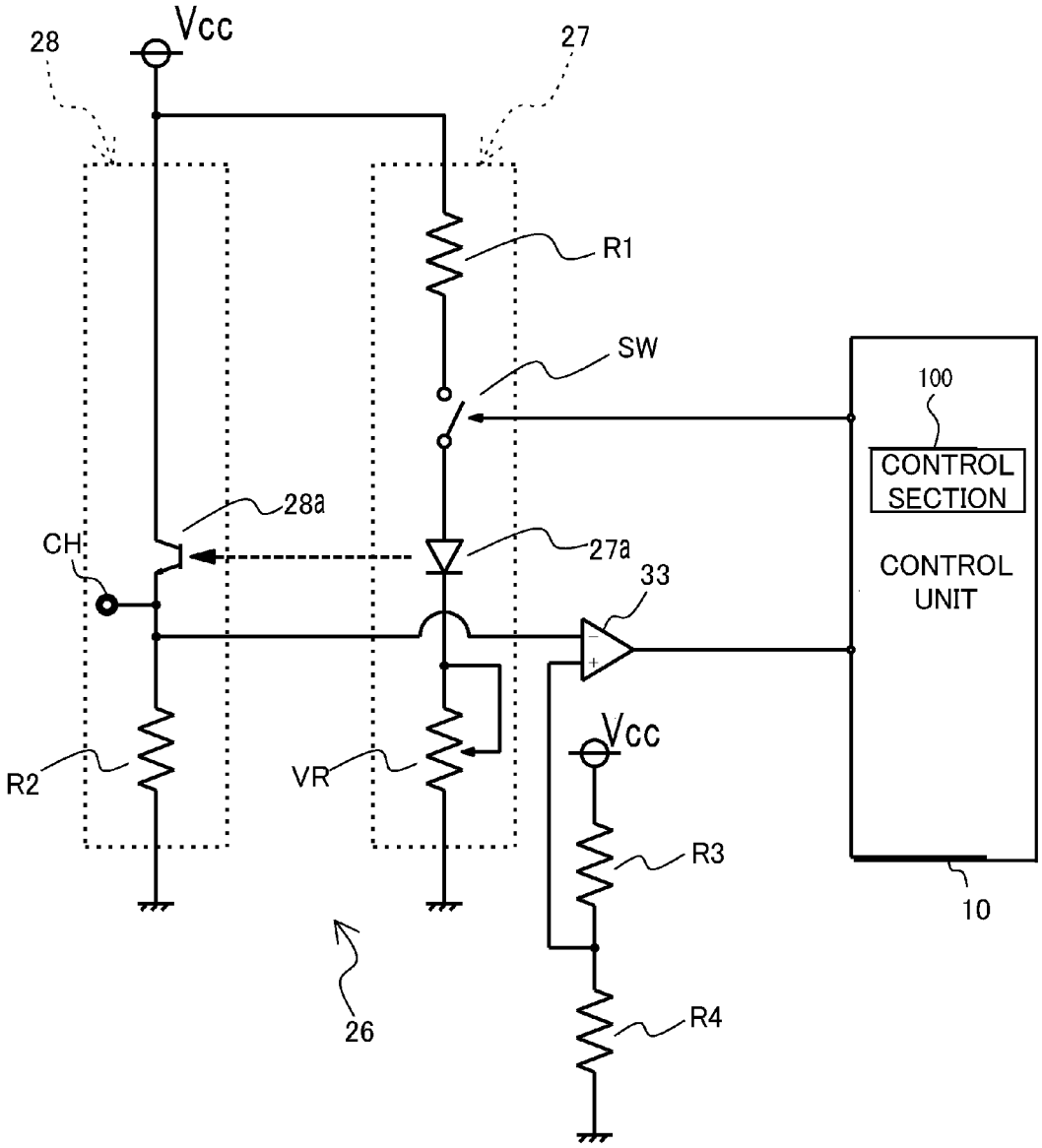
FIG. 7 is a circuit diagram showing an example of an optical sensor in the image forming apparatus according to the first embodiment of the present disclosure.

FIG. 7 is a circuit diagram showing an example of an optical sensor in the image forming apparatus according to the first embodiment of the present disclosure. The optical sensor 26 is made up by including the light-emitting part 27 and the light-receiving part 28. The anode side of an LED 27*a* constituting a component of the light-emitting part 27 is connected to one end of a lighting control switch SW, and the other end of the lighting control switch SW is connected through a current-limiting resistor R1 to a power supply Vcc.

On the other hand, the cathode side of the LED 27*a* is grounded through a variable resistor VR serving as a light intensity adjuster. Furthermore, the variable resistor VR is configured to be adjustable by a driver or the like. The variable resistor VR is an example of the adjusting section defined in What is claimed is.

A phototransistor 28*a* constituting a component of the light-receiving part 28 is opposed to the LED 27*a* and configured to receive light emitted from the LED 27*a* and control the current flowing between its collector terminal and its emitter terminal according to the amount of light incident on its base terminal. The collector terminal of the phototransistor 28*a* is connected to the power supply Vcc and the emitter terminal thereof is ground through a current-limiting resistor R2 and connected to the minus (−) terminal of a comparator 33.

The plus (+) terminal of the comparator 33 is connected to a connection point between resistors R3 and R4. The resistors R3 and R4 are voltage-dividing resistors connected in series between the power supply Vcc and the ground. The comparator 33 is operable to compare a threshold value obtained by the resistors R3 and R4 with a voltage value supplied from the phototransistor 28*a*. When the voltage value from the phototransistor 28*a* is higher than the threshold value, the comparator 33 outputs a Low signal. When the voltage value from the phototransistor 28*a* is lower than the threshold value, the comparator 33 outputs a High signal. The signal output from the comparator 33 is sent to the control unit 10.

Thus, when there is no obstacle between the LED 27*a* and the phototransistor 28*a*, so that the voltage value from the phototransistor 28*a* is higher than the threshold value, the Low signal from the comparator 33 is output to the control unit 10. When there is any obstacle between the LED 27*a* and the phototransistor 28*a*, so that the voltage value from the phototransistor 28*a* is lower than the threshold value (for example, when the waste toner bottle 41 has been filled with waste toner), the High signal from the comparator 33 is output to the control unit 10.

In this manner, information on the presence or absence of a change in the amount of light received by the phototransistor 28*a* (i.e., information indicating whether or not the waste toner bottle 41 is filled with waste toner) is transferred to the control unit 10, so that the control section 100 of the control unit 10 can determine whether or not the waste toner bottle 41 has been filled with waste toner.

Furthermore, the emitter terminal of the phototransistor 28*a* is connected to a check terminal CH. An operator can monitor the amount of light received by the phototransistor 28*a* by connecting a digital voltmeter or the like to the check terminal CH. The check terminal CH is an example of the detecting section defined in What is claimed is.

The above description has been given of the case where the comparator 33 is used to compare the voltage value supplied from the phototransistor 28*a* with the threshold value. Alternatively, in another embodiment, it is possible that the voltage value supplied from the phototransistor 28*a* is directly output to the control unit 10 without the comparator 33 and converted from analog to digital values in the control unit 10 and the control section 100 uses the obtained digital value to compare the voltage value supplied from the phototransistor 28*a* with the threshold value.

For example, the control section 100 determines whether or not the obtained digital value is equal to or larger than a digital value indicating the threshold value. When the obtained digital value is smaller than the digital value indicating the threshold value, the control section 100 determines that the waste toner bottle 41 has been filled with waste toner.

Figure 8A:
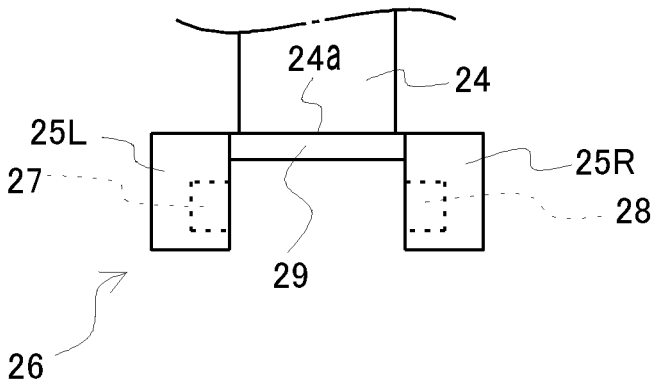
FIG. 8A is an explanatory view for illustrating the placement of a shielding member in the first embodiment of the present disclosure, showing a state where the shielding member has not yet been put in place.
Figure 8B:
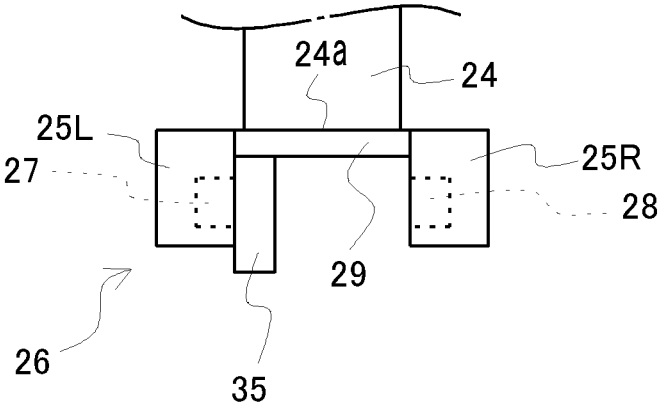
FIG. 8B is an explanatory view for illustrating the placement of the shielding member in the first embodiment of the present disclosure, showing a state where the shielding member has been put in place.

Next, a description will be given of a method for adjusting the light intensity of the light-emitting part 27 of the optical sensor 25, with reference to FIGS. 7, 8A, and 8B. FIGS. 8A and 8B show a state around the waste toner discharge pipe 24 when the waste toner bottle 41 is removed from the apparatus body 11.

First, as shown in FIG. 8B, in a state where the waste toner bottle 41 is removed from the apparatus body 11, a shielding member 35 made of a material having a predetermined light transmittance is manually placed between the light-emitting part 27 and the light-receiving part 28. The predetermined light transmittance is set at a value equivalent to the light transmittance of waste toner existing between the light-emitting part 27 and the light-receiving part 28 of the optical sensor 20 when the waste toner has been accumulated in the waste toner bottle 41 to fill up the waste toner bottle 41 and has become an obstacle between the light-emitting part 27 and the light-receiving part 28. The light transmittance when the waste toner bottle 41 is filled with waste toner is determined, for example, by theoretical calculation based on the nature or structure of toner or experimental measurement.

When the switch SW shown in FIG. 7 is closed (turned ON), the LED 27*a* is supplied with a current from the power supply Vcc to emit light. Thereafter, the light intensity of the LED 27*a* is gradually increased by using a driver or the like to gradually lower the resistance value of the variable resistor VR, which has been initially set at the maximum, while monitoring the voltage value at the check terminal CH. Because during the initiation of the light intensity adjustment the light intensity of the LED 27*a* is small and substantially no light reaches the phototransistor 28*a* owing to the effect of the shielding member 35, the voltage value at the check terminal CH is near 0 V.

When the light intensity of the LED 27*a* is gradually increased, the amount of light permeating the shielding member 35 gradually increases and, then, the voltage value at the check terminal CH reaches a predetermined condition (for example, the threshold value obtained between the resistors R3 and R4). The variable resistor VR is fixed at a resistance when the predetermined condition is reached. The light intensity of the LED 27*a* is set at a level exhibited when the predetermined condition is reached.

In the first embodiment, in the above manner, the shielding member 35 is placed to create a light-transmitting environment equivalent to that when the waste toner bottle 41 is filled with waste toner. Furthermore, in the created light-transmitting environment, the light intensity of the light-emitting part 27 is adjusted according to a change in the output of the light-receiving part 28 and set at a level exhibited when the output of the light-receiving part 28 reaches the predetermined condition. Thus, an appropriate light intensity value of the light-emitting part 27 at which the optical sensor 28 can detect the presence or absence of waste toner exists can be accurately acquired and set.

The light-emitting part 27 adjusted in light intensity in the above manner is used, without the placement of the shielding member 35, to actually detect the amount of waste toner accumulated in the waste toner bottle 41. When in this case the waste toner bottle 41 has been filled with waste toner, the output of the light-receiving part 28 reaches the predetermined condition, so that the output signal of the comparator 33 changes from Low to High. Therefore, it can be detected from the change in the output of the light-receiving part 28 that the waste toner bottle 41 has been filled with waste toner.

Hence, by a simple task of placing the shielding member 35 and adjusting and setting the light intensity of the light-emitting part 27 according to a change in the output of the light-receiving part 28, the light intensity of the light-emitting part 27 can be accurately adjusted within an appropriate range for detecting that the waste toner bottle 41 is filled with waste toner.

Although in this embodiment the voltage value at the emitter terminal of the phototransistor 28*a* is monitored, the present disclosure is not limited to this. For example, the signal output from the comparator 33 may be monitored to detect the timing with which the signal from the comparator 33 changes from Low to High.

Generally, because waste toner collected in the waste toner bottle is light, it is not only accumulated in the waste toner bottle but also drifts on the air in the waste toner bottle and in some cases adheres to a transparent exit window for protecting the LED constituting a component of the light-emitting part. If the waste toner adheres to the exit window, the amount of light reaching the phototransistor constituting a component of the light-receiving part is significantly reduced, which may invite a situation where even though the waste toner bottle is not full, it is erroneously determined to be full. To prevent such a false detection, it is necessary to set the light intensity of the light-emitting part as high as possible.

However, if the light intensity of the light-emitting part is too high, the output of the light-receiving part decreases very little even when the waste toner bottle is full, so that no difference in the amount of light in the light-receiving part may be created and the waste toner bottle may not be determined to be full. Therefore, the light intensity of the light-emitting part needs to be low to the extent that a detectable difference in the amount of light in the light-receiving part is created between when the waste toner bottle is filled with waste toner and just before it is filled with waste toner.

The task for setting the light intensity of the light-emitting part at an appropriate level is influenced by not only performance variations among individual LEDs and among individual phototransistors but also the misalignment of optical axes of the pair of LED and phototransistor, the distance between them, and so on. Therefore, the task requires much time and effort. In addition, while there is known a technique for adjusting the sensitivity of light falling on the phototransistor, there is no known technique for adjusting the sensitivity of the optical sensor by adjusting the light intensity of the LED.

In the above-described first embodiment, the light intensity of the light-emitting part of the optical sensor can be accurately and easily adjusted within an appropriate range for detecting that the waste toner bottle 41 is filled with waste toner.

Next, a description will be given of an image forming apparatus according to a second embodiment of the present disclosure.

Figure 9A:
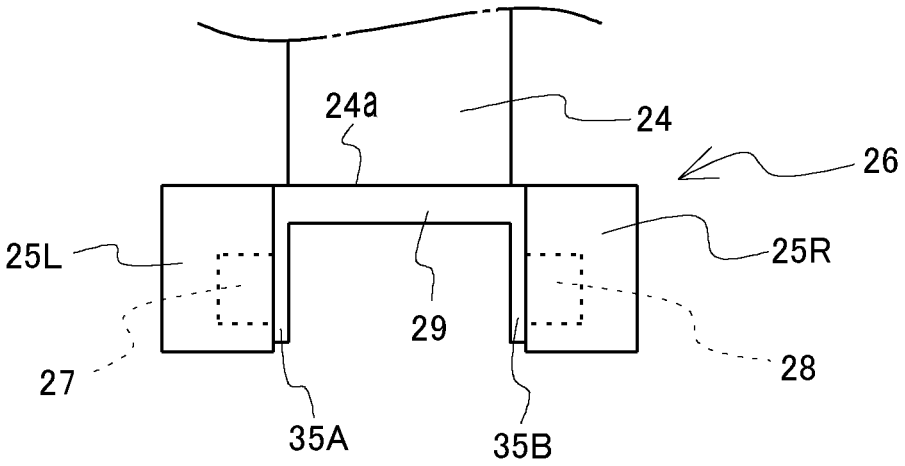
FIG. 9A is a front view schematically showing a shielding member and its surrounding region in a second embodiment of the present disclosure.

FIG. 9A is a front view schematically showing a shielding member and its surrounding region in the second embodiment of the present disclosure. The same components as those of the image forming apparatus described in the first embodiment will be designated by the same references and further explanation thereof will be omitted here.

Although the description in the first embodiment has been given of the case where the operator manually places the shielding member 35 between the light-emitting part 27 and the light-receiving part 28 to adjust the light intensity of the light-emitting part 27, this embodiment is different from the first embodiment in that the apparatus body 11 is previously equipped with the shielding member 35.

Reference numerals 35A and 35B in FIG. 9 represent shielding members that create the above-described light-transmitting environment, wherein the shielding member 35A is disposed near the light-emitting part 27 and the shielding member 35B is disposed near the light-receiving part 28. These shielding members 35A and 35B are configured to exhibit the above-described predetermined transmittance by their intervention between the light-emitting part 27 and the light-receiving part 28.

More specifically, by the intervention of both the shielding members 35A, 35B between the light-emitting part 27 and the light-receiving part 28, the light-transmitting environment capable of blocking light emitted from the light-emitting part 27 to a degree equivalent to the case where the waste toner bottle 41 is full is created like the shielding member 35 shown in FIG. 8B. The light-transmitting environment may be implemented by the two shielding members 35A, 35B in this manner or implemented by employing a transparent member in place of one of the two shielding members and employing a member having the predetermined transmittance in place of the other shielding member.

The shielding members 35A, 35B are formed integrally with the movable shutter 29 capable of covering the discharge port 24*a* of the waste toner discharge pipe 24. Thus, when the waste toner bottle 41 is not attached to the apparatus body 11, the shielding members 35A, 35B are located near the light-emitting part 27 and the light-receiving part 28. When the waste toner bottle 41 is attached to the apparatus body 11, the shielding members 35A, 35B can be moved, operatively with the movement of the movable shutter 29 inwardly of the apparatus body 11 as shown in FIG. 6A, away from the light-emitting part 27 and the light-receiving part 28 to the position at which they do not interfere with the detection of whether the waste toner bottle 41 is full. The discharge port 24*a* and the movable shutter 29 are examples of the discharge port and the movable shutter, respectively, defined in What is claimed is.

As seen from the above, since in the second embodiment the shielding members 35A, 35B are disposed at appropriate locations without involving a direct manipulation of the operator, the burden on the operator can be reduced. In addition, since the shielding members 35A, 35B are formed integrally with the movable shutter 29 and configured to move operatively with the movement of the movable shutter 29, there is no need to additionally provide a dedicated mechanism for moving the shielding members 35A, 35B, which can avoid the apparatus being complicated and suppress the rise in cost.

Figure 9B:
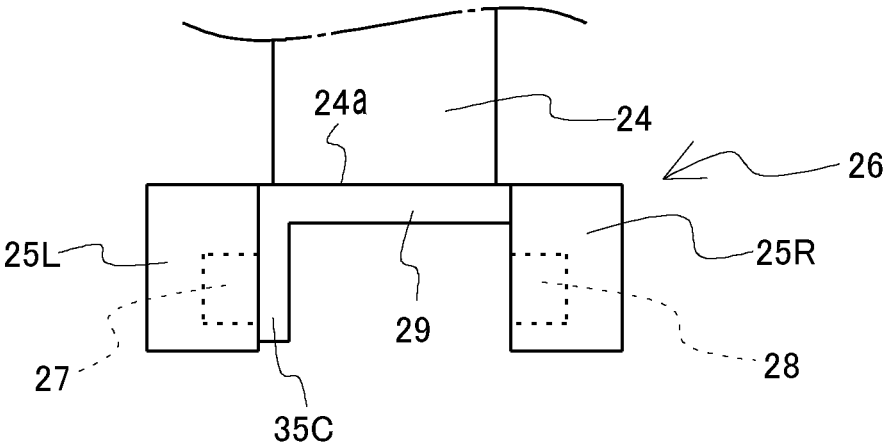
FIG. 9B is a front view schematically showing a shielding member and its surrounding region in another embodiment of the present disclosure.

Although the description in the second embodiment has been given of the case where the shielding members 35A and 35B are disposed near the light-emitting part 27 and the light-receiving part 28, respectively, the present disclosure is not limited to this. A single shielding member 35C may be disposed near either one of the light-emitting part 27 and the light-receiving part 28. For example, as shown in FIG. 9B, the shielding member 35C may be disposed near the light-emitting part 27 only.

Another embodiment may be configured so that the control section 100 can adjust the resistance value of the variable resistor VR, the voltage value given from the phototransistor 28*a* is output to the control unit 10 and converted from analog to digital values in the control unit 10, and the control section 100 uses the converted digital value to automatically adjust the resistance value of the variable resistor VR.

For example, when the waste toner bottle 41 is not attached to the apparatus body 11 (i.e., when the movable shutter 29 is located near the light-emitting part 27 and the light-receiving part 28), such as at the time for replacement of the waste toner bottle 41, the control section 100 adjusts the resistance value of the variable resistor VR while monitoring the voltage value given from the phototransistor 28*a* and sets the resistance value of the variable resistor VR at a level exhibited when the voltage from the phototransistor 28*a* reaches a predetermined value. Thus, calibration can be performed.

The structures, configurations, and processing shown in the above embodiments with reference to FIGS. 1 to 9B are merely illustrative of the present disclosure and the present disclosure is not intended to be limited to the above structures, configurations, and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an optical sensor including a light-emitting part and a light-receiving part opposed to the light-emitting part, the optical sensor being configured to detect an amount of waste toner accumulated in a waste toner container, the waste toner being produced with formation of an image and then accommodated in the waste toner container;

a check terminal connected to the light-receiving part and configured to detect a change in an output of the light-receiving part;

a shielding member interposed between the light-emitting part and the light-receiving part and configured to create, between the light-emitting part and the light-receiving part, a light-transmitting environment equivalent to that when the waste toner container is filled with the waste toner;

a variable resistor connected to the light-emitting part, the variable resistor being configured to be able to adjust a light intensity of the light-emitting part by changing a resistance value when the shielding member is interposed between the light-emitting part and the light-receiving part; and a movable shutter capable of covering a discharge port which leads to a developing device and through which the waste toner is to be discharged to the waste toner container, wherein when the waste toner container is removably attached to an apparatus body of the image forming apparatus, the movable shutter is moved to a position where the discharge port is open, when the waste toner container is removed from the apparatus body, the movable shutter is moved to a position where the discharge port is closed, the shielding member is formed integrally with the movable shutter, when the waste toner container is attached to the apparatus body, the shielding member is moved to a position not interposed between the light-emitting part and the light-receiving part, and when the waste toner container is removed from the apparatus body, the movable shutter is moved to a position interposed between the light-emitting part and the light-receiving part.

2. The image forming apparatus according to claim 1, wherein the movable shutter is provided with an urging member attached thereto, the urging member urging the movable shutter in a direction of removal of the waste toner container from the apparatus body, the direction of removal being opposite to a direction of attachment of the waste toner container to the apparatus body, when the waste toner container is removed from the apparatus body, the movable shutter is urged by the urging member and thus moved to the position where the discharge port is closed, and when the waste toner container is attached to the apparatus body, the movable shutter is pressed in the direction of attachment by the waste toner container against the urging of the urging member and thus moved to the position where the discharge port is open.

3. The image forming apparatus according to claim 2, wherein the shielding member is formed integrally with the movable shutter and configured to be capable of abutting on at least one of the light-emitting part and the light-receiving part, and when the waste toner container is removed, the shielding member is moved to the position interposed between the light-emitting part and the light-receiving part and abuts on the at least one of the light-emitting part and the light-receiving part.

4. The image forming apparatus according to claim 1, further comprising a control section configured to, when the waste toner container is removed from the apparatus body, change the resistance value of the variable resistor to adjust the light intensity of the light-emitting part according to the change in the output of the light-receiving part the output being output from the check terminal, and set the light intensity of the light-emitting part at a level exhibited when the output of the light-receiving part reaches a predetermined condition.

5. A method for adjusting a sensitivity of an optical sensor configured to detect an amount of waste toner accumulated in a waste toner container, the waste toner being produced with formation of an image and then accommodated in the waste toner container, the method comprising the steps of:

interposing, between a light-emitting part and a light-receiving part of the optical sensor a shielding member configured to create a light-transmitting environment equivalent to that when the waste toner container is filled with the waste toner; and a movable shutter capable of covering a discharge port which leads to a developing device and through which the waste toner is to be discharged to the waste toner container, the movable shutter being moved to a position where the discharge port is open when the waste toner container is removably attached to an apparatus body of an image forming apparatus and being moved to a position where the discharge port is closed when the waste toner container is removed from the apparatus body, the shielding member being formed integrally with the movable shutter, being moved to a position not interposed between the light-emitting part and the light-receiving part when the waste toner container is attached to the apparatus body, and being moved to a position interposed between the light-emitting part and the light-receiving part when the waste toner container is removed from the apparatus body; and adjusting a light intensity of the light-emitting part according to a change in an output of the light-receiving part and setting the light intensity of the light-emitting part at a level exhibited when the output of the light-receiving part reaches a predetermined condition.

* * * * *